US009388562B2

(12) United States Patent
Thomas

(10) Patent No.: US 9,388,562 B2
(45) Date of Patent: Jul. 12, 2016

(54) BUILDING SYSTEM USING MODULAR PRECAST CONCRETE COMPONENTS

(71) Applicant: Rocky Mountain Prestress, LLC, Denver, CO (US)

(72) Inventor: Phillip Michael Thomas, Thornton, CO (US)

(73) Assignee: Rocky Mountain Prestress, LLC, Denver, CO (US)

( * ) Notice: Subject to any disclaimer, the term of this patent is extended or adjusted under 35 U.S.C. 154(b) by 0 days.

(21) Appl. No.: 14/710,358

(22) Filed: May 12, 2015

(65) Prior Publication Data

US 2015/0345127 A1 Dec. 3, 2015

Related U.S. Application Data

(60) Provisional application No. 62/004,322, filed on May 29, 2014.

(51) Int. Cl.

| | |
|---|---|
| ***E04B 1/04*** | (2006.01) |
| ***E04B 1/20*** | (2006.01) |
| ***E04B 5/04*** | (2006.01) |

(52) U.S. Cl.

CPC .... *E04B 1/20* (2013.01); *E04B 5/04* (2013.01)

(58) Field of Classification Search

CPC ..... E04B 1/00; E04B 1/20; E04B 1/04; E04B 1/043; E04B 2103/02; E04B 5/04

USPC ..... 52/252, 236.3, 283, 260, 236.5, 263, 52/322, 262, 253, 251

See application file for complete search history.

(56) References Cited

U.S. PATENT DOCUMENTS

| | | | | | |
|---|---|---|---|---|---|
| 1,599,042 | A * | 9/1926 | Day | E04B 2/28 | 52/250 |
| 3,302,339 | A * | 2/1967 | White | E04H 6/10 | 14/71.1 |
| 3,613,325 | A * | 10/1971 | Yee | E04B 1/20 | 52/236.8 |
| 3,707,819 | A * | 1/1973 | Calhoun | E04B 5/04 | 52/220.6 |
| 3,708,933 | A * | 1/1973 | Yang | E04H 6/08 | 52/236.1 |
| 3,712,008 | A * | 1/1973 | Georgiev | E04B 1/35 | 52/236.3 |
| 3,818,660 | A * | 6/1974 | Dillon | E04B 1/161 | 52/251 |
| 4,302,915 | A * | 12/1981 | Stocks | E04H 6/10 | 52/175 |
| 5,704,181 | A * | 1/1998 | Fisher | E04B 1/24 | 52/338 |
| 5,906,076 | A * | 5/1999 | McManus | E04B 5/23 | 249/188 |

(Continued)

FOREIGN PATENT DOCUMENTS

| | | | |
|---|---|---|---|
| CA | 1208029 | * | 7/1986 |
| JP | 06306956 A | * | 11/1994 |

*Primary Examiner* — Brent W Herring

(74) *Attorney, Agent, or Firm* — Dorr, Carson & Birney PC

(57) ABSTRACT

A building system with modular precast concrete components uses bulb tee beams to span between walls that are distributed within the building footprint to open up the structure. Shallow corrugated slabs span between the bulb tee beams to form the floor deck. Optionally, double tee beams can be used at the periphery of the structure for longer spans.

7 Claims, 12 Drawing Sheets

(56) References Cited

U.S. PATENT DOCUMENTS

| | | | | |
|---|---|---|---|---|
| 6,442,908 | B1 * | 9/2002 | Naccarato | E04B 5/43 52/236.8 |
| 8,011,147 | B2 | 9/2011 | Hanlan | |
| 8,671,634 | B2 * | 3/2014 | Morcous | E04B 5/16 52/252 |
| 2005/0183357 | A1 * | 8/2005 | Heuvel | E01D 2/02 52/250 |
| 2008/0060293 | A1 * | 3/2008 | Hanlon | E04B 1/20 52/251 |
| 2013/0074430 | A1 * | 3/2013 | Morcous | E04B 5/16 52/252 |
| 2014/0041328 | A1 * | 2/2014 | Stehle | E04B 5/023 52/250 |
| 2015/0013255 | A1 * | 1/2015 | Hunt | E04B 1/20 52/236.3 |
| 2015/0167289 | A1 * | 6/2015 | Wang | E04H 1/04 52/236.3 |

* cited by examiner

BUILDING SYSTEM USING MODULAR PRECAST CONCRETE COMPONENTS

RELATED APPLICATION

The present application is based on and claims priority to the Applicant's U.S. Provisional Patent Application 62/004,322, entitled "Building System Using Modular Precast Concrete Components," filed on May 29, 2014.

BACKGROUND OF THE INVENTION

1. Field of the Invention

The present invention relates generally to the field of building construction using precast concrete components. More specifically, the present invention discloses a building system using modular precast concrete components that generally eliminates the use of large shear walls or moment frames to resist lateral loads.

2. Statement of the Problem

Most precast building structures, specifically parking structures, use large shear wall 140 or light wall 150 elements as the primary mechanism for resisting lateral loads, as shown for example in FIG. 1. Columns 110 are generally used to resist gravity loads. Though shear walls 140 and light walls 150 in conventional precast structures also can support gravity loads, the lateral and gravity load resistances are generally mutually exclusive in the overall behavior of the structure.

Examples of conventional precast framing are shown in FIGS. 1-5. One conventional approach uses precast double tee beams 120 spanning up to about sixty feet between light walls 150 or inverted tee beams 130 to create the floor system. The double tee beams 120 and inverted tee beams 130 generally bear on corbels 170 that project off the faces of the columns 110, pilasters 180 or spandrels 160. The inverted tee beams 130 are generally supported by columns 110 or shear walls that have pilasters 180 (i.e., an integral column). Due to the inherent separation of the components for resisting lateral loads and gravity loads in such construction systems, and because the columns are not lateral load resisting elements, conventional precast structures lose the economic advantages of combining both.

As a result, such precast structures tend to lack some of the other benefits seen in cast-in-place construction. Cast-in-place structures are perceived to be more open and provide better lighting distribution than precast structures. There is also a perception that cast-in-place structures are more resistant to cracking because the floor deck is post-tensioned and has fewer joints. Additionally, because cast-in-place structures inherently provide continuity in the floor deck, they are stiffer than precast floor decks. Due to the fact that precast structures generally use shear walls and light walls as the lateral resisting elements, the structures tend to feel closed off. Cast-in-place construction generally makes use of moment-frame systems to resist lateral loads, which allow for increased openness and lighting distribution. Therefore, a need exists for a precast building solution that provides greater openness, better light distribution, a stiffer floor deck and that largely eliminates the need for large shear walls and light walls to thereby enhance visibility within the structure.

3. Solution to the Problem

The present invention addresses these shortcomings of prior-art precast building systems by using bulb tee beams, shallow corrugated slabs and double tee beams supported on small walls that also function as columns and are distributed within the building footprint to open up the structure. In particular, as shown in FIGS. 6-13, the top flange of the bulb tee beams 230 supports the corrugated slabs 220 and double tee beams 120. The bulb tee beams 230 generally bear on corbels 170 and span in the same direction as double tee beams 120 in traditional precast construction. However, they have a much larger spacing which creates more openness.

Corrugated slabs 220 span between the bulb tee beams 230 and the sections can be both designed for maximum performance and efficiency. These slabs 220 are extremely shallow when compared to what has been used in traditional precast structures. The corrugated slabs 220 can also be connected to adjacent members by a keyway 240 as seen in FIG. 8(*a*). This keyway 240 allows for additional stiffness and strength at the joint to effectively seal the joint from moisture penetration. Preferably, the corrugated slabs 220 are also reinforced with negative moment rebar as seen in FIG. 10(*a*) at the ends to promote continuity that also increases the strength and stiffness of the floor deck.

The walls 210 act as vertical cantilevers to support the structure laterally as well as vertically. The walls 210 are oriented in such a manner that they take the lateral force in the long direction of the wall, and are turned ninety degrees where needed to take the same force in the other direction. The wall spacing and orientation allows for a dramatically open space.

At the ends of the structure, double tee beams 120 can be used for the longer floor spans and are supported by spandrels 160 on one end and bulb tee beams 230 on the other. This eliminates drop beams typically seen both in precast and cast-in-place structures for greater openness and light distribution.

SUMMARY OF THE INVENTION

This invention provides a building system with modular precast concrete components. Bulb tee beams span between walls that are distributed within the building footprint to open up the structure. Shallow corrugated slabs span between the bulb tee beams to form the floor deck. Optionally, double tee beams can be used at the periphery of the structure for longer spans.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 8(*a*) is a detail vertical cross-sectional view showing the keyway 240 between two adjacent corrugated slabs 220.

FIG. 10(*a*) is a detail vertical cross-sectional view showing an example of continuity at the ends of adjacent corrugated slabs 220.

DETAILED DESCRIPTION OF THE INVENTION

Figure 1:
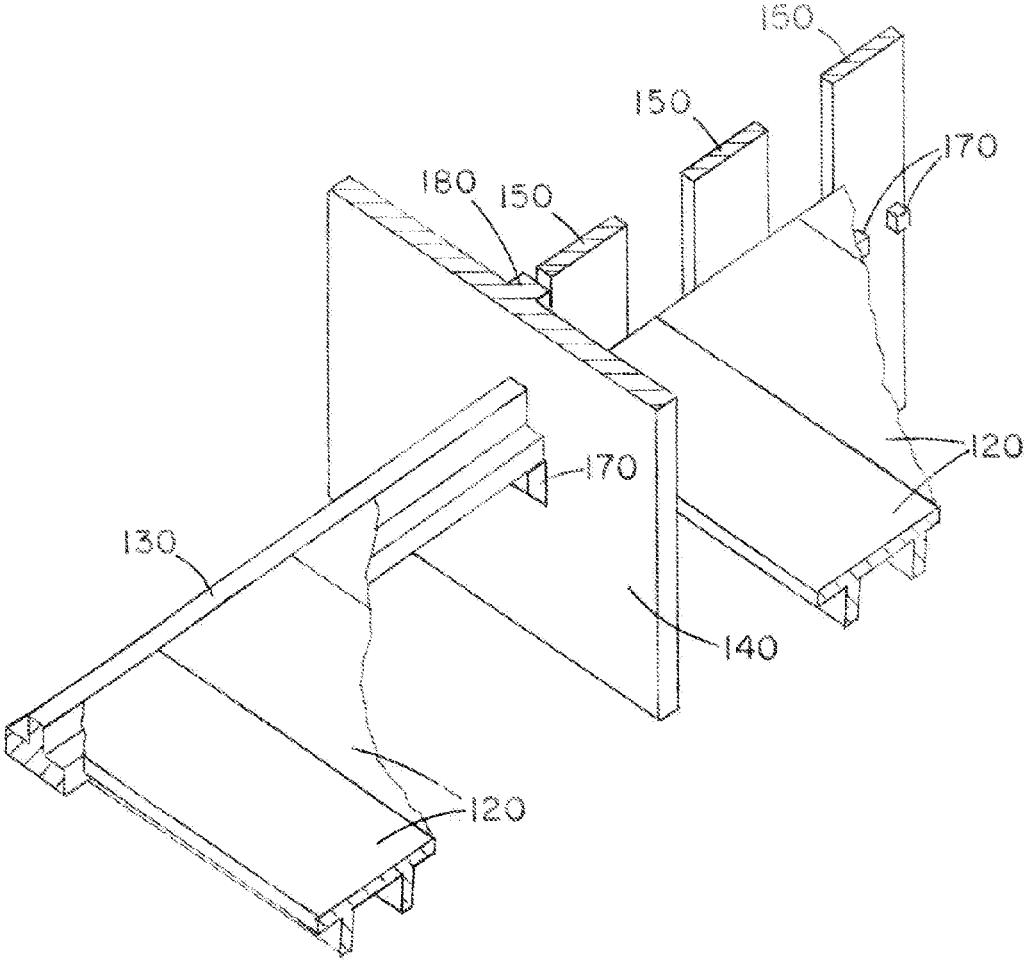
Fig. 1 ( Prior Art )
FIG. 1 is an isometric view showing an example of conventional precast building framing.
Figure 2:
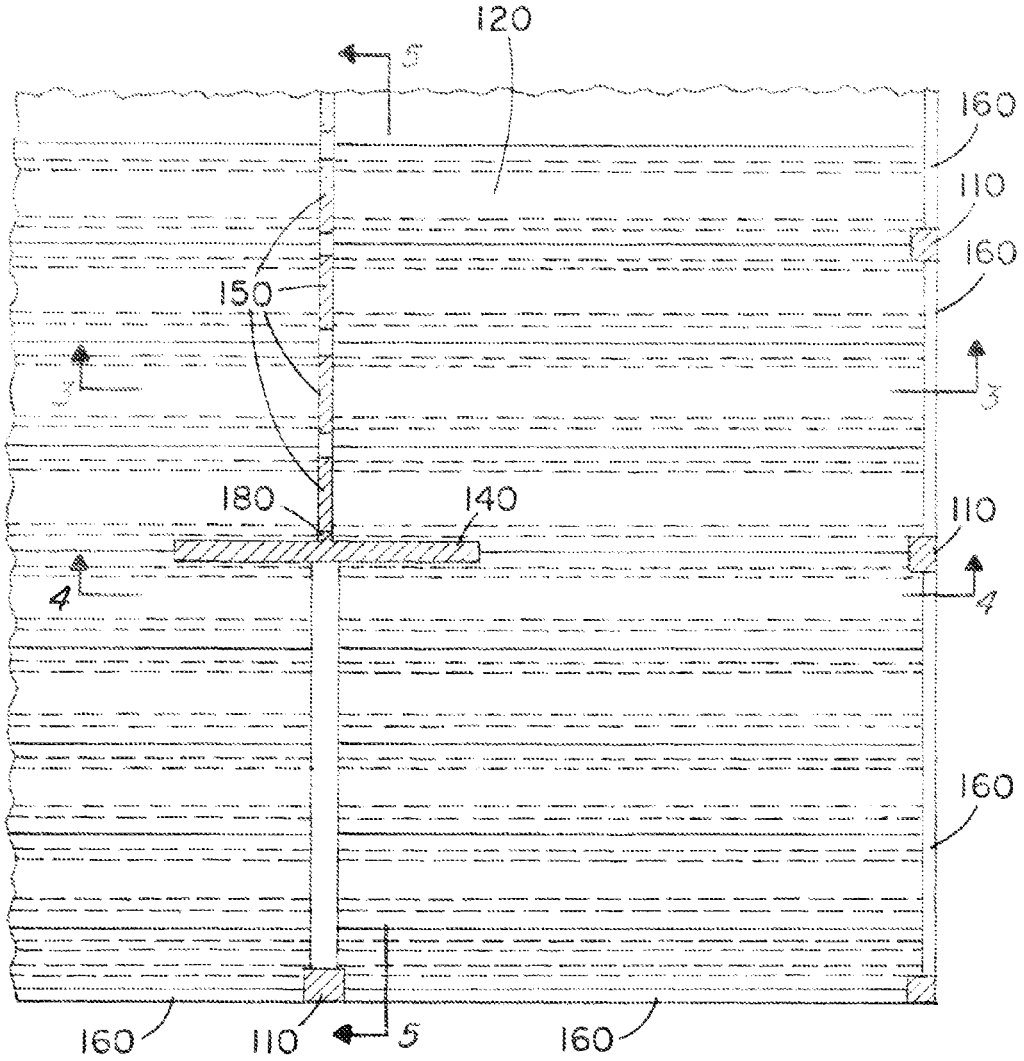
Fig. 2 ( Prior Art )
FIG. 2 is a cross-sectional view along a horizontal plane showing an example of conventional precast building framing.
Figure 3:
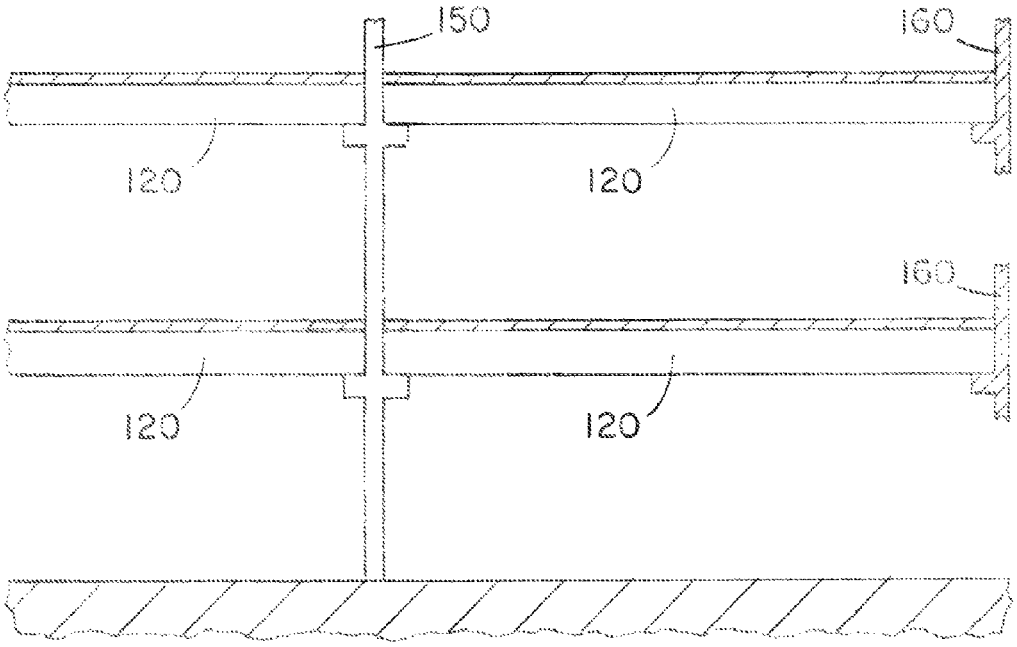
Fig. 3 ( Prior Art )
FIG. 3 is a vertical cross-sectional view corresponding to FIG. 2.
Figure 4:
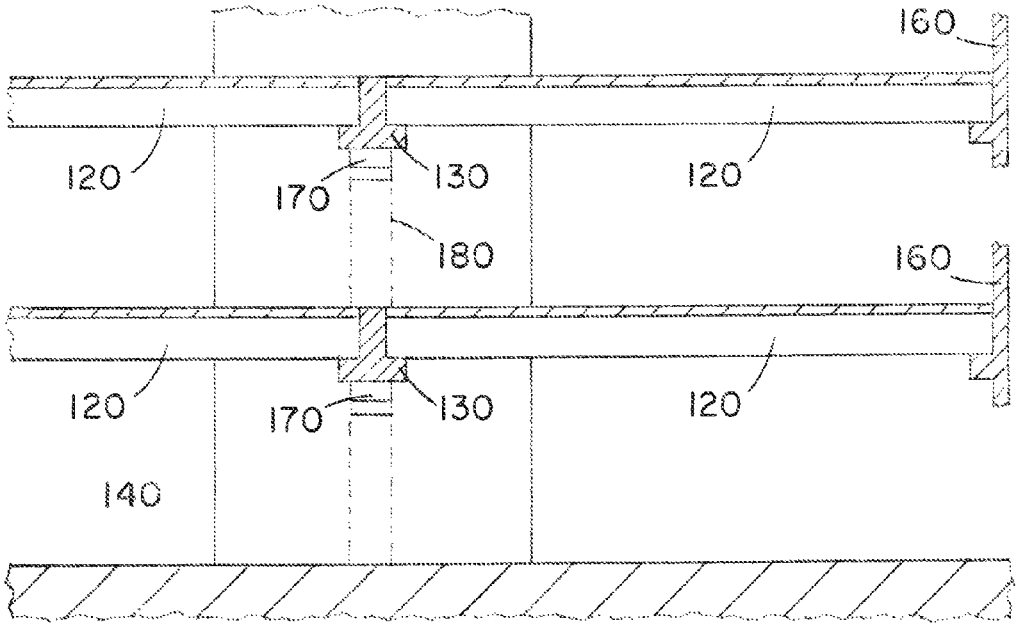
Fig. 4 ( Prior Art )
FIG. 4 is another vertical cross-sectional view corresponding to FIG. 2, but taken at a different location than FIG. 3 for clarity.
Figure 5:
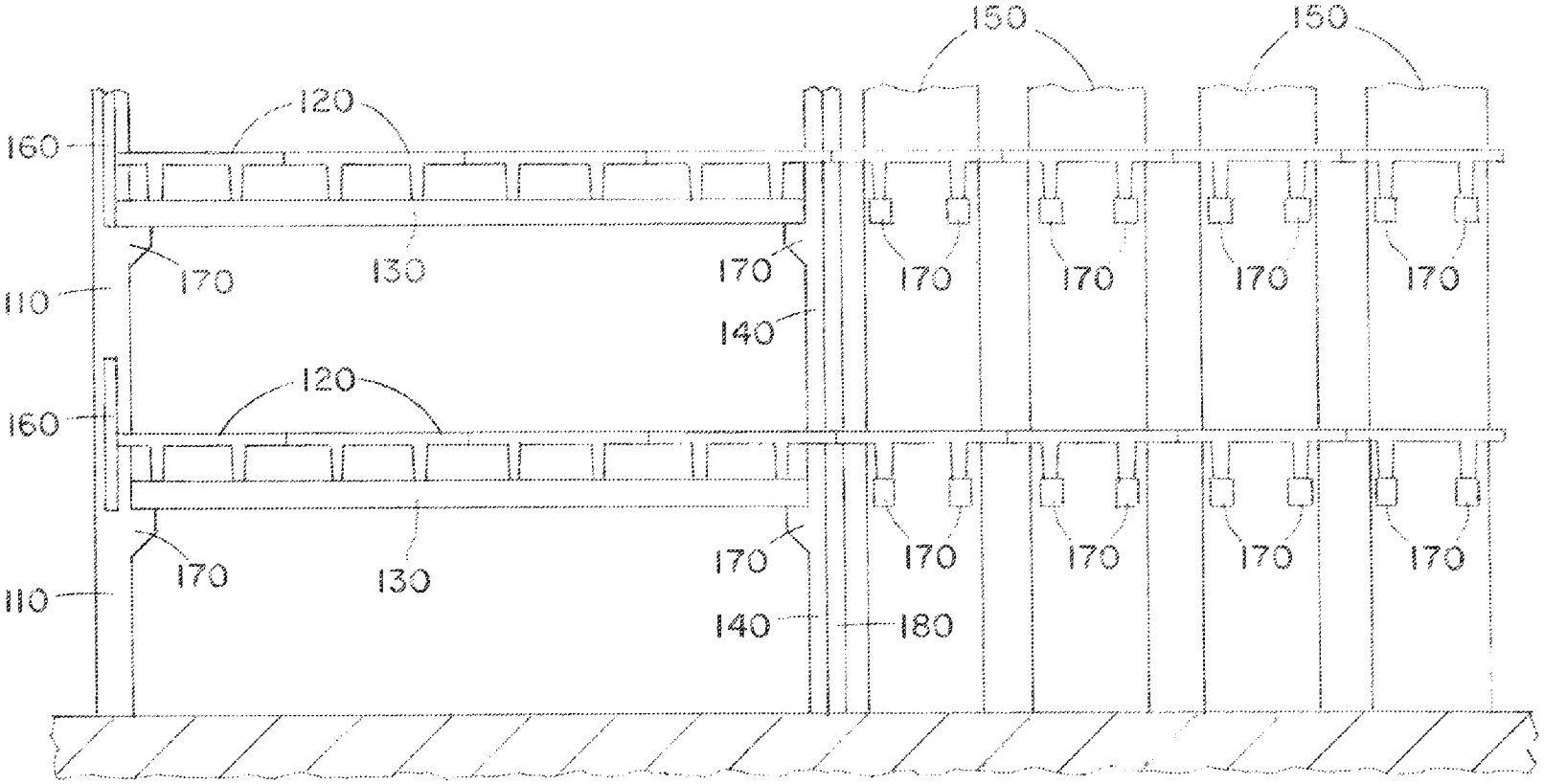
Fig. 5 ( Prior Art )
FIG. 5 is a vertical cross-sectional view corresponding to FIG. 2 taken along a plane perpendicular to FIGS. 3 and 4.
Figure 6:
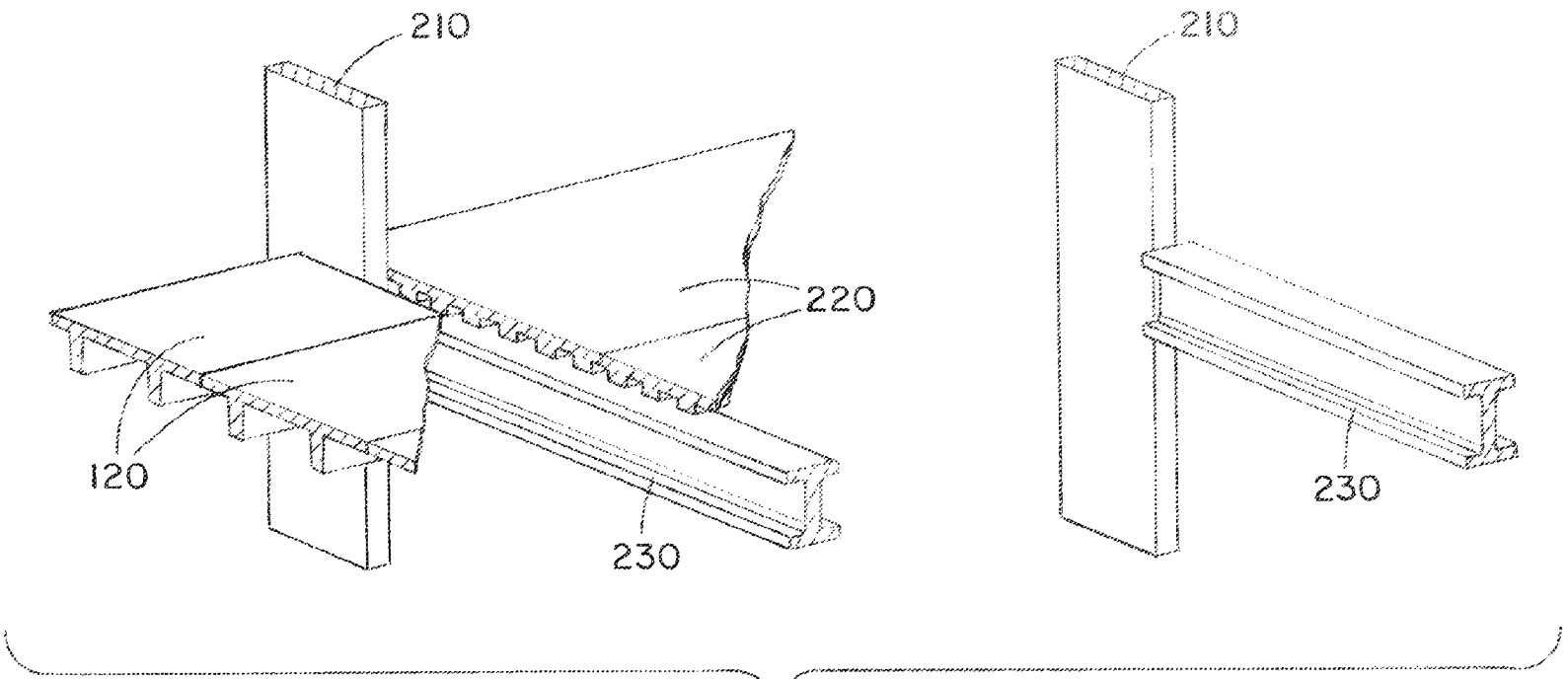
FIG. 6 is an isometric view showing an example of precast building framing using components of the present invention.
Figure 7:
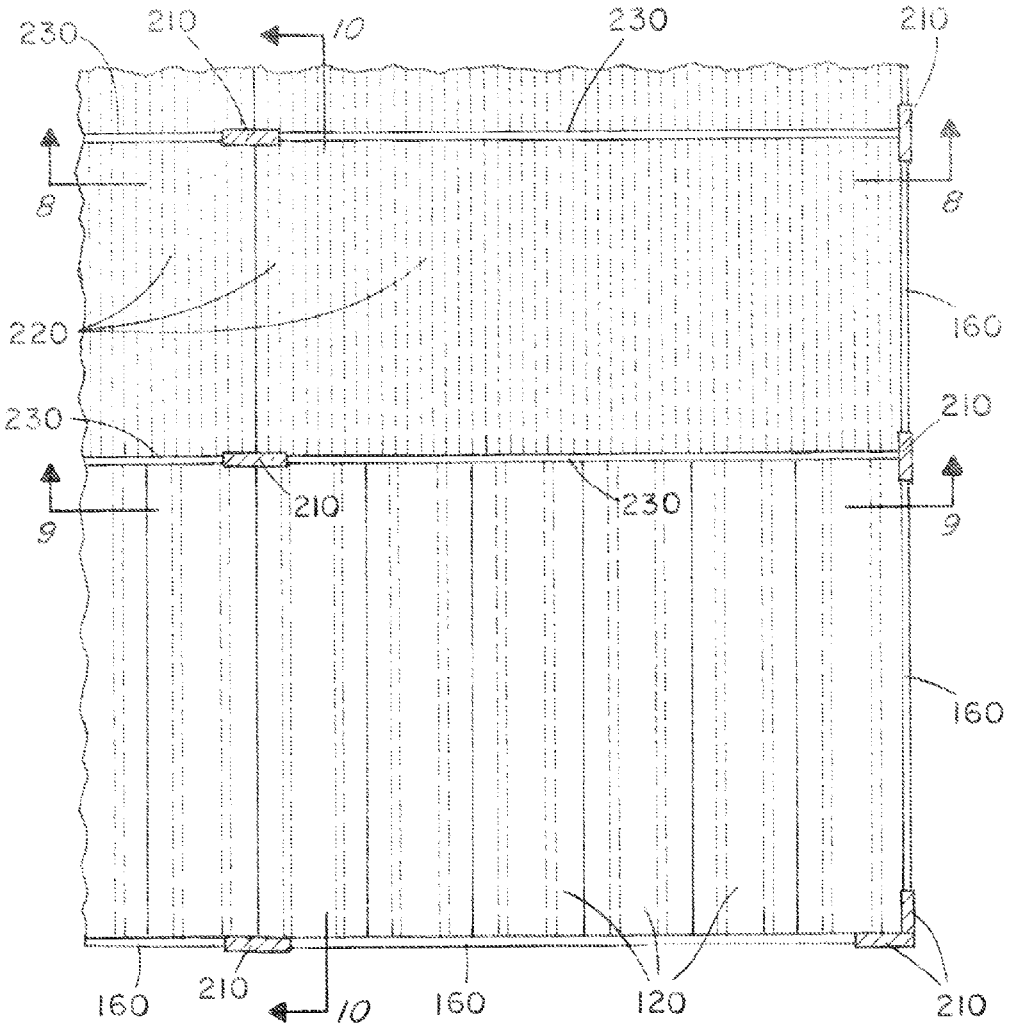
FIG. 7 is a cross-sectional view along a horizontal plane showing an example of precast building framing using components of the present invention.
Figure 12:
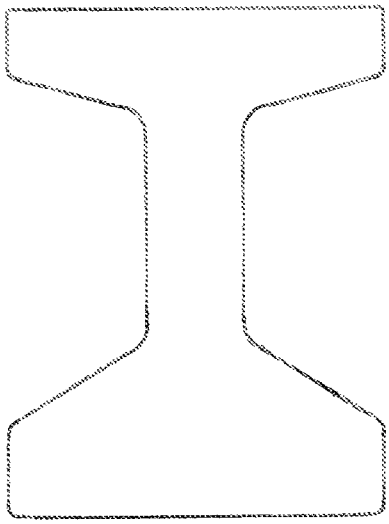
FIGS. 12 and 12(*a*) are cross-sectional views showing embodiments of the bulb tee beam 230 section.
Figure 12A:
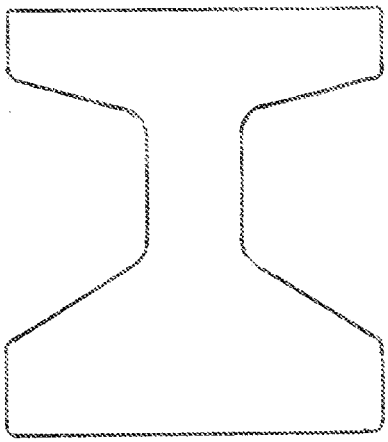
Figure 13:
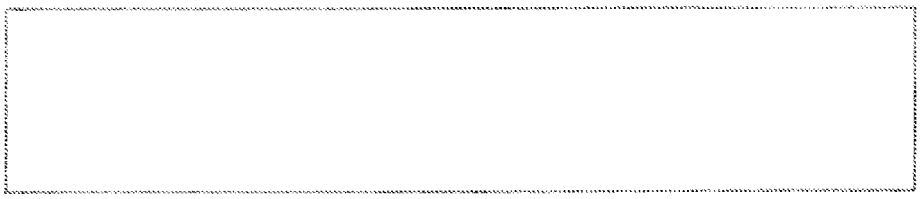
FIG. 13 is a cross-sectional view showing an embodiment of the wall 210 section.

Turning to FIG. 6, an isometric view is provided showing an embodiment of the present invention. Corresponding cross-sectional views are provided in the remaining FIGS. 7-13. The major components include a series of bulb tee beams 230 spanning between walls 210 within the building footprint, and shallow corrugated slabs 220 that span between the bulb tee beams 230 to form the floor deck. The bulb tee beams 230 can span up to 62 feet and bear on precast concrete corbels 170 on the walls 210. Examples of the geometries of these members can be seen in FIGS. 12 and 12(*a*). In this embodiment, bulb tee beams 230 have a height of 2½ to 3 feet, and a width of about 2 feet, 3 inches. The web and flanges of the bulb tee beams 230 can have corresponding dimensions and proportions as illustrated, for example, in FIGS. 12 and 12(*a*). The bulb tee beams 230 are typically oriented in the same direction as double tee beams in conventional precast building framing. The spacing of the bulb tee beams 230 allows for greater openness and lighting distribution within the building.

The walls 210 serve as gravity and lateral load resisting elements. Conventional precast building construction generally separates the lateral and gravity load resisting systems with shear walls 140 and columns 110, respectively, as shown in FIGS. 1-5. With the present invention, they are combined to enhance cost and aesthetic limitations seen in conventional precast building construction. The walls are distributed in such a manner that greater openness and light distribution occur. An example of a wall 210 cross-section can be seen in FIG. 13. In this embodiment, the wall 210 has a thickness of about one foot and a length of four to six feet.

The corrugated slabs 220 are shallow flexural members that span up to about thirty feet between the tops of adjacent bulb tee beams 230. The corrugated slabs 220 typically run perpendicular to the bulb tee beams 230 and are placed adjacent and parallel to one another to form the floor deck. These elements are generally used at the interior of the structure. An example of the cross-sectional geometry of a corrugated slab 220 can be seen in FIG. 11. In this embodiment, the corrugated slab 220 has a width of about 12 feet, 4 inches. The corrugated ridges have a thickness of about 5½ inches and a width of about 8 inches. The horizontal spacing between adjacent corrugated ridges is about 18 inches.

Figure 8:
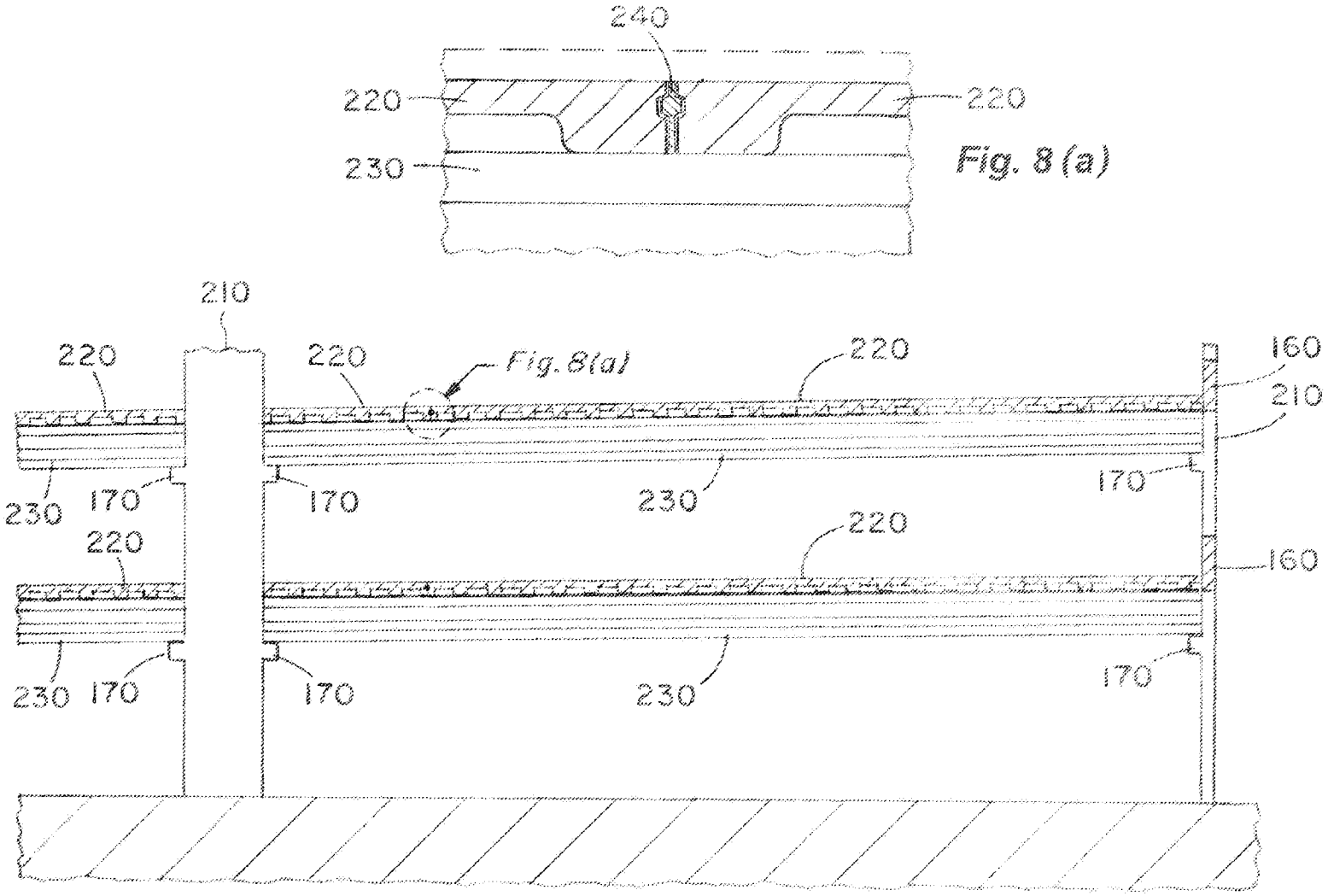
FIG. 8 is a vertical cross-sectional view corresponding to FIG. 7.
Figure 9:
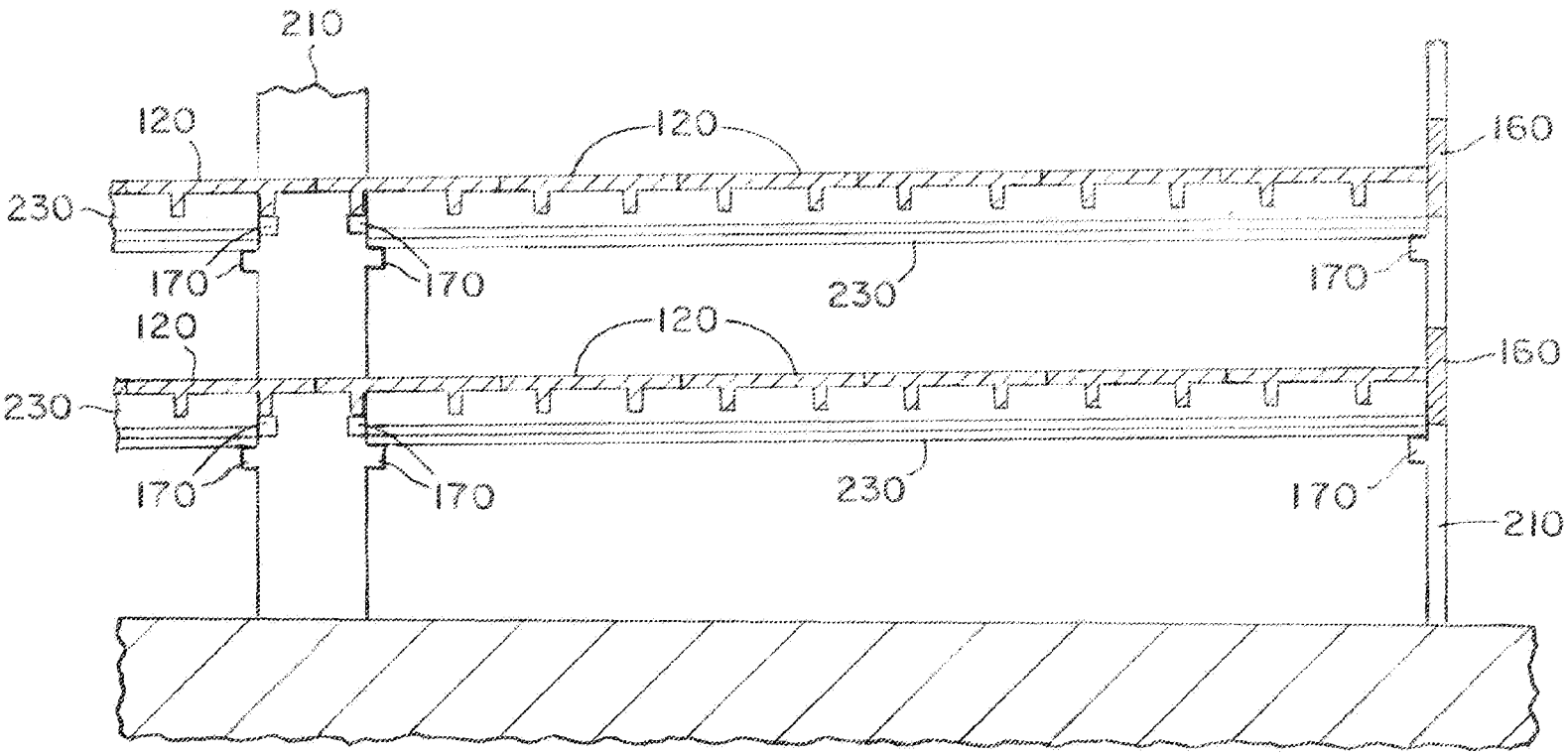
FIG. 9 is a vertical cross-sectional view corresponding to FIG. 7, but taken at a different location than FIG. 8 for clarity.
Figure 10A:
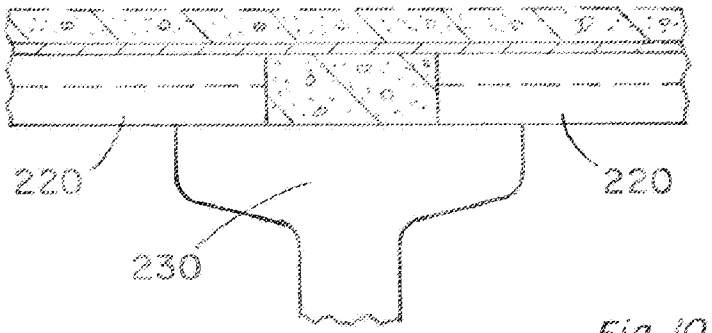
FIG. 10 is a vertical cross-sectional view corresponding to FIG. 7 taken along a plane perpendicular to FIGS. 8 and 9.
Figure 10:
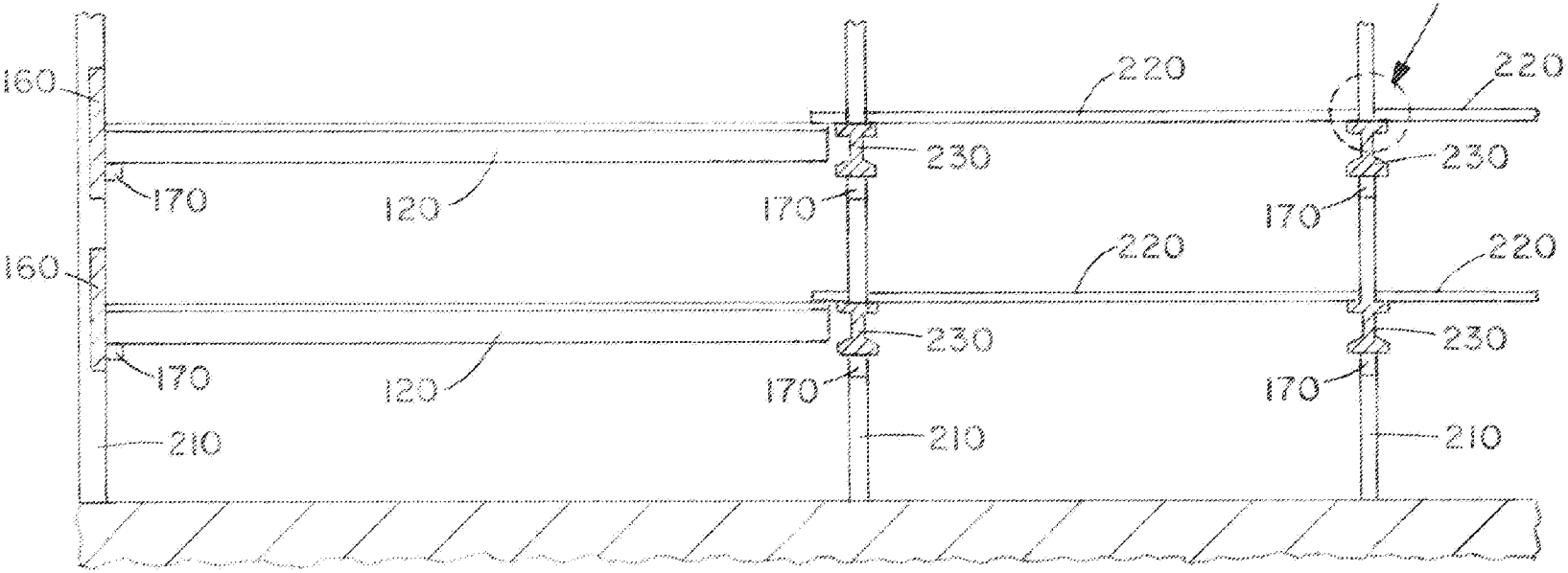
Figure 11:
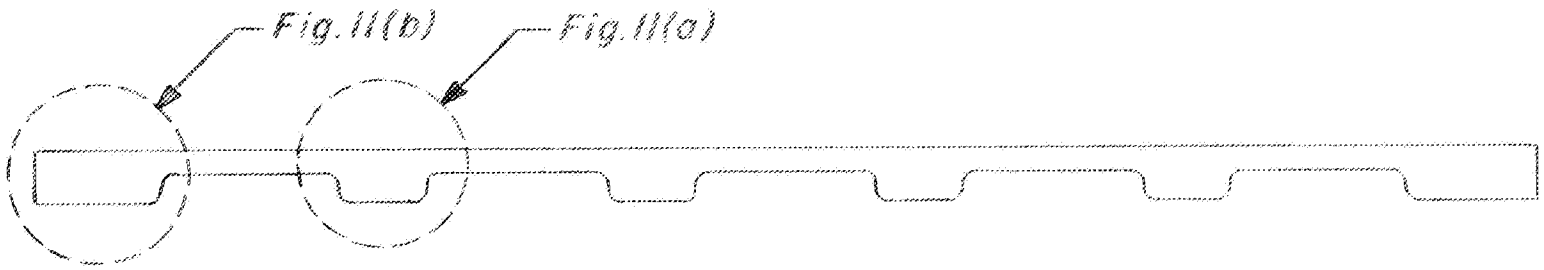
FIGS. 11, 11(*a*) and 11(*b*) are cross-sectional views showing an embodiment of the corrugated slab 220 section.
Figure 11B:
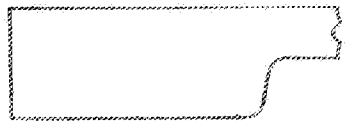
Figure 11A:
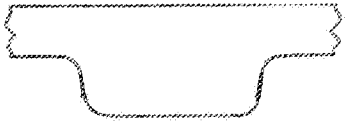

The floor deck is stronger and stiffer using such corrugated slabs 220 because of the keyways 240 as seen in FIG. 8(*a*) on either side of the member and the negative moment reinforcement at the ends as seen in FIG. 10(*a*). Conventional precast building framing generally employs double tee framing and does not allow for the use of keyways at the joints between members. The double tee stem spacing also hinders openness and lighting distribution in conventional precast building construction. With the present invention, this concern is removed. This component also spans perpendicular to double tees in conventional precast building framing. Optionally, a concrete topping layer can be applied to the upper surfaces of the corrugated slabs 220 to create a floor structure.

Optionally, double tee beams 120 can also be used in the present invention, although in a different way. Preferably, corrugated slabs 220 are used in the interior of the building structure, while double tee beams 120 can be used to create a floor structure at the periphery. In other words, the double tee beams 120 are preferably only used at the ends of the structure and span between the bulb tee beams 230 and peripheral walls. It should be noted that this is perpendicular to the double tees beams in conventional precast building framing. The double tee beams 120 also bear on the top of the bulb tee beams 230 in the present invention, instead of on inverted-tee beam 130 ledges. This allows the double tee beams 120 in the present invention to be much higher than those used in conventional precast building framing. This promotes greater openness and light distribution within the structure.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A building system comprising a plurality of precast concrete components to create a structure having an interior and a periphery, said building system including:

a plurality of walls spaced apart from one another in a predetermined pattern;

a plurality of bulb tee beams spanning between and supported by the walls, said bulb tee beams having an upper flange;

a plurality of shallow corrugated slabs spanning between and supported by the upper flanges of the bulb tee beams to provide a floor surface at the interior of the structure; and a plurality of double tee beams supported by the upper flanges of the bulb tee beams and peripheral walls to provide a floor surface at the periphery of the structure.

2. The building system of claim 1 wherein corrugated slabs have ends, and further comprising keyways connecting the ends of adjacent corrugated slabs.

3. The building system of claim 1 wherein the double tee beams are supported between the bulb tee beams and spandrels in the peripheral walls.

4. The building system of claim 1 wherein the walls are oriented to resist lateral loads transmitted by the bulb tee beams along the length of walls.

5. The building system of claim 1 wherein the corrugated slabs are perpendicular to the bulb tee beams.

6. The building system of claim 1 further comprising a concrete topping layer on the corrugated slabs and double tee beams.

7. The building system of claim 1 wherein the bulb tee beams bear on corbels on the walls.

* * * * *